US006540508B1

(12) United States Patent
Simpson et al.

(10) Patent No.: US 6,540,508 B1
(45) Date of Patent: Apr. 1, 2003

(54) PROCESS OF INSTALLING ROOF MOUNTED OXYGEN-FUEL BURNERS IN A GLASS MELTING FURNACE

(75) Inventors: Neil George Simpson, Sylvania, OH (US); John R. LeBlanc, Perrysburg, OH (US); Thomas G. Clayton, Toledo, OH (US); Greg Floyd Prusia, Holland, OH (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/664,570

(22) Filed: Sep. 18, 2000

(51) Int. Cl.[7] ..... F27D 1/00; C03B 5/00

(52) U.S. Cl. ..... 431/154; 431/159; 431/187; 432/247; 65/335

(58) Field of Search ..... 431/154, 159, 431/187; 432/159, 247, 251; 65/65, 157, 335

(56) References Cited

U.S. PATENT DOCUMENTS

| | | | | |
|---|---|---|---|---|
| 1,832,371 A | * | 11/1931 | Evans et al. | 431/187 |
| 3,337,324 A | | 8/1967 | Cable et al. | |
| 4,004,875 A | * | 1/1977 | Zink et al. | 431/187 |
| 4,168,950 A | * | 9/1979 | Seemann et al. | 431/348 |
| 4,531,960 A | | 7/1985 | Desprez et al. | |
| 4,565,560 A | | 1/1986 | Krumwiede et al. | |
| 4,655,812 A | | 4/1987 | Blumenfeld | |
| 4,816,056 A | | 3/1989 | Tsai et al. | |
| 4,986,748 A | | 1/1991 | Brown et al. | |
| 5,139,558 A | | 8/1992 | Lauwers | |
| 5,178,921 A | * | 1/1993 | Whelan | 110/182.5 |
| 5,431,559 A | | 7/1995 | Taylor | |
| 5,458,483 A | | 10/1995 | Taylor | |
| 5,551,867 A | * | 9/1996 | Shamp | 431/154 |
| 5,611,682 A | | 3/1997 | Slavejkov et al. | |
| 5,833,447 A | | 11/1998 | Bodelin et al. | |
| 5,984,667 A | | 11/1999 | Philippe et al. | |
| 6,068,468 A | | 5/2000 | Philippe et al. | |
| 6,397,765 B1 | * | 6/2002 | Becker | 432/247 |
| 2002/0078712 A1 | * | 6/2002 | Harris et al. | 65/335 |

FOREIGN PATENT DOCUMENTS

| | | |
|---|---|---|
| WO | WO99/31021 | 6/1999 |

* cited by examiner

*Primary Examiner*—Sara Clarke
(74) *Attorney, Agent, or Firm*—Joshua L. Cohen; Salvatore P. Page

(57) ABSTRACT

A process for installing a refractory burner block in a glass furnace crown, wherein the glass furnace crown comprises a second refractory material different than the burner block refractory, includes installing a refractory crown block in the furnace crown, wherein the crown block refractory is compatible with the burner block refractory and the second refractory material, wherein the crown block is provided with a hole for accepting the burner block; and disposing the burner block into the crown block hole in sealing engagement therewith. A process for installing a refractory burner block in a hot glass furnace crown, wherein the glass furnace crown comprises a second refractory material different than the burner block refractory, includes removing crown insulation from the exterior of the furnace crown; inserting a patch of refractory material compatible with the furnace crown second refractory material into the crown in the vicinity of the removed insulation; drilling a hole into the crown through the refractory patch, optionally with a water cooled diamond drill; and, inserting the refractory burner block into the hole in the furnace crown through the refractory patch. A process for installing a refractory burner block in a glass furnace crown, wherein the glass furnace crown comprises a highly thermally conductive fused cast refractory material, includes installing an insulating barrier mounting block on the upper surface of the furnace crown, wherein the mounting block is compatible with the burner block refractory and the fused cast refractory material, wherein the mounting block is provided with a hole for accepting the burner block, and wherein the insulating barrier mounting block is prepared when the furnace crown is not hot; and disposing the burner block into the mounting block hole in sealing engagement therewith.

49 Claims, 9 Drawing Sheets

PROCESS OF INSTALLING ROOF MOUNTED OXYGEN-FUEL BURNERS IN A GLASS MELTING FURNACE

FIELD OF THE INVENTION

This invention relates to the process of installing at least one roof mounted oxygen-fuel burner in a glass melting furnace. More particularly the invention relates to the process which includes the preparation of the furnace refractory roof to accept the roof-mounted oxygen fuel burner, and the preparation and conditioning of the refractory ceramic burner block, followed by its installation.

BACKGROUND OF THE INVENTION

With the exception of cold top electric furnaces, glass melting furnaces typically have a refractory roof, commonly known as the crown. The selection of refractory materials for the crown is governed by the type of glass being manufactured, and specifically the ability of the refractory i) to withstand the glass melting temperature requirements and ii) to resist volatile species liberated in the glass melting process.

Conventionally, glass furnaces have not been equipped with burners built into the crown of the furnace. Glass batch materials have traditionally been melted using one, or a combination of, electrodes or flames that are generated substantially horizontally with respect to the surface of the glass batch materials, from burners mounted in the furnace walls, or associated with regenerative air ports.

Recently, it has been proposed to install roof-mounted gas burners, such as oxygen-fuel burners, in refractory lined glass melters. These burners are directed downwards at an angle greater than 45° with respect to the surface of the glass forming material, and are controlled such that a generally columnar fuel and oxygen flow combusts proximate to the top surface of the glass forming material, to produce a flame that impinges the surface of the raw glass forming material. This permits a significant increase in heat transfer into the glass, while maintaining refractory temperatures within safe operating limits, and avoiding the overheating of the roof and walls of the furnace. This technology approach is described in U.S. Ser. No. 08/992,136, now U.S. Pat. No. 6,237,369 (corresponding to PCT Publication WO 99/31021) and U.S. Ser. No. 9/374,921, both of which are incorporated herein by reference as if fully written out below.

When roof mounted burners are installed in a new furnace before initial firing, the characteristics of the furnace refractory can sometimes be accommodated by the burner block to be provided. In other instances, incompatibilities of the materials of the furnace refractory and the burner block must be taken into account. This is a particular problem in retrofit installations, where at least one roof mounted burner is to be installed in an existing furnace structure.

Because of the high operating temperatures in the furnace crown and the potentially high temperature of the oxygen-fuel flame, the selection of the burner block refractory material is critical. In certain conditions, there may be material incompatibilities between the burner block materials and the crown materials which necessitates a barrier between the two materials. Representative ceramic materials that are utilized in either the furnace refractory or the burner blocks are silica, alumina zirconia silicate (AZS), zirconia, zircon (zirconia silicate), and fused cast alumina refractories.

Retrofit installations involve drilling the crown either hot or cold depending upon the furnace status. If a new furnace or new crown section is prepared while the furnace is cold, there is the opportunity to either drill a hole or install a prepared section with the hole pre-drilled or cast. When the burner is installed in a hot furnace which is already in operation, there is a requirement to minimise the risk of thermal shock. In any circumstance, due to risk of damage to the refractory materials in the crown, the exterior surface of the crown must be prepared to enable a gas tight seal when the burner block is installed.

SUMMARY OF THE INVENTION

The present invention is directed to a process for installing at least one oxygen-fuel burner in the crown of glass melting furnaces having various refractory constructions and utilising burner blocks of different materials in both hot and cold retrofit applications, and in new purpose built applications.

The present invention provides a process for installing a refractory burner block in a glass furnace crown, wherein the glass, furnace crown comprises a second refractory material different than the burner block refractory, comprising:

installing a refractory crown block in the furnace crown, wherein the crown block refractory is compatible with the burner block refractory and the second refractory material, wherein the crown block is provided with a hole for accepting the burner block; and disposing the burner block into the crown block hole in sealing engagement therewith.

Optionally, the crown block has a greater overall depth than the furnace crown refractory.

The present invention further provides a process for installing a refractory burner block in a hot glass furnace crown, wherein the glass furnace crown comprises a second refractory material different than the burner block refractory, comprising:

removing crown insulation from the exterior of the furnace crown;

inserting a patch of refractory material compatible with the furnace crown second refractory material into the crown in the vicinity of the removed insulation;

drilling a hole into the crown through the refractory patch, optionally with a water cooled diamond drill; and, inserting the refractory burner block into the hole in the furnace crown through the refractory patch.

In one embodiment, wherein the burner block refractory is incompatible with the furnace crown second refractory material, the process includes applying a chemical barrier to the external surfaces of the burner block refractory, which chemical barrier is chemically compatible with the furnace crown second refractory material, prior to insertion in the furnace crown.

In another embodiment, the present invention provides a process for installing a refractory burner block in a glass furnace crown, wherein the glass furnace crown comprises a refractory material, comprising:

installing an insulating barrier mounting block on the upper surface of the furnace crown, wherein the mounting block is compatible with the burner block refractory and the refractory material, wherein the mounting block is provided with a hole for accepting the burner block, and wherein the insulating barrier is prepared when the furnace crown is not hot; and, disposing the burner block into the mounting block hole in sealing engagement therewith.

This embodiment is preferably utilized when the furnace crown refractory material is a highly thermally conductive fused cast refractory material.

In a further embodiment, the present invention provides a process for installing an externally staged oxygen-fuel burner in a glass furnace crown, comprising:

drilling in the furnace crown, at least a first hole for accepting a burner block and at least a second hole for accepting at least one externally staged oxygen injector means;

positioning a first transition block spacer over the first hole, said first transition block spacer being provided with a burner block hole for accepting the burner block in communication with the first hole;

positioning one of the first transition block spacer and an optional at least second transition block spacer over the at least second hole, said first or at least second transition block spacer being provided with at least one oxygen injector hole for accepting the oxygen injector means in communication with the at least second hole, inserting the burner block through the first transition block spacer into the first hole in sealing engagement;

inserting an externally staged oxygen injector means through at least one of said first and second transition block spacer into the at least second hole in sealing engagement; and applying a castable material to seal the first and optional second transition block spacer.

DETAILED DESCRIPTION OF THE PREFERRED EMBODIMENTS

Figure 1:
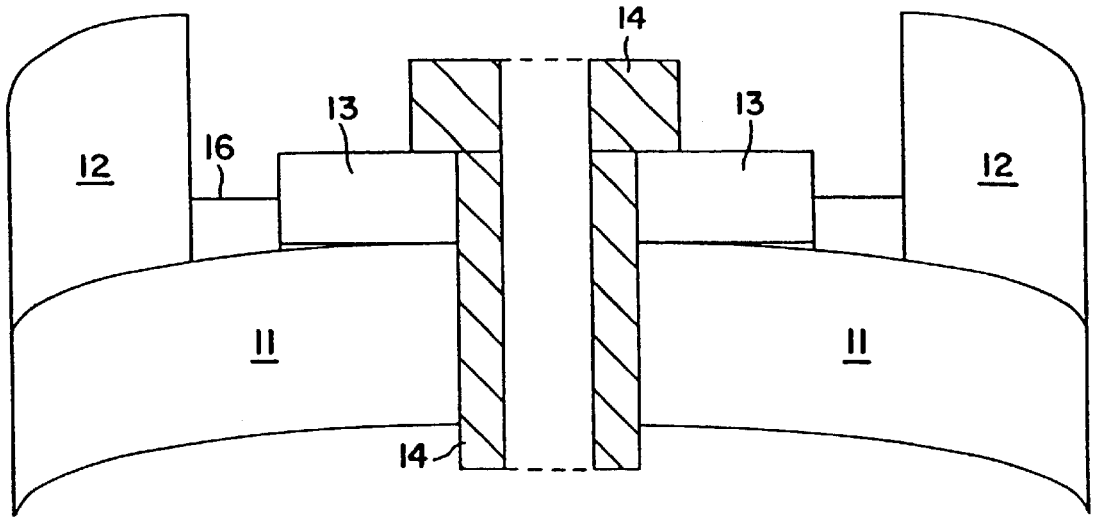
FIG. 1 is a schematic, elevational, cutaway view of a fused silica burner block in a silica crown.

In the glass furnaces for which the present invention is intended, a typical burner discharges a mixture of fuel and either air or oxygen in a particular ratio of fuel to oxidant, to produce a combustible mixture. Once ignited, this combustible mixture burns to produce a flame that is used to heat and melt the glass batch materials.

Suitable fuels for combustion include, but are not limited to, methane, natural gas, liquefied natural gas, propane, atomized oil and low BTU gases or the like, at either ambient temperature or in preheated form. Preferred oxidants include oxygen-enriched air containing at least 50 volume percent oxygen, such as "industrially" pure oxygen (99.5%) produced by a cryogenic air separation plant, non-pure oxygen produced by e.g. a vacuum swing adsorption process (about 88% and above) or "impure" oxygen produced from air or any other source by filtration, adsorption, absorption, membrane separation, or the like, at either ambient temperature or in preheated form. The fuel and the oxidant are introduced in the furnace through a burner assembly. (As oxygen is the preferred oxidant according to the present invention, oxygen will be used throughout the specification without intending to limit the scope of the invention as to other suitable oxidants, such as air.)

The burner assembly includes a burner block formed to include a flame chamber having inlet and outlet openings, means for discharging fuel into a flame chamber formed in the burner block and means for discharging oxygen into the flame chamber. In operation, discharged oxygen mixes with fuel provided by the discharging means inside the flame chamber. This combustible fuel and oxygen mixture can be ignited to define a flame having a root portion in the flame chamber and a tip portion outside the flame chamber. If the burner assembly to be used comprises an internally "staged" burner for secondary combustion purposes, the burner block may further include bypass means for conducting oxygen outside of the flame chamber, such as to oxygen-discharge ports around the outlet opening of the flame chamber. In operation, oxygen may pass through the bypass means formed in the burner block to the oxygen-discharge ports, and be ejected from the burner block into a downstream "second-stage" region containing a portion of the flame and lying outside the flame chamber in the furnace, to heat the glass batch materials or melt.

In preferred embodiments, the burner block is made of a refractory material and includes an outside wall formed to include the flame chamber inlet opening and a plurality of oxygen-admission ports around the inlet opening. The burner block also includes a furnace wall configured to lie in a furnace and formed to include the flame chamber outlet opening and the plurality of oxygen-discharge ports around the outlet opening. In alternative embodiments, one or more oxidant entry means can be provided external to the burner block, as described below, to enable staged combustion to be effected in the furnace.

Suitable materials for the refractory burner block include but are not limited to silica, zirconia ($ZrO_2$), fused cast alumina-zirconia-silica (AZS), rebonded AZS, or fused cast alumina ($Al_2O_3$). The particular material chosen is determined, in part, by the type of glass to be melted in the glass furnace.

In general, the burner block is used to provide an entry point in a furnace for mounting a burner, and to protect the burner from corrosive species and high furnace temperatures. The process of the present invention is not limited to the burner assemblies described above, but includes any suitable assemblies used in glass furnaces, including those which comprise conventional water-cooled "tube in tube" design burners, such as those used for injection of natural gas surrounded by an annular oxygen stream, or gas cooled oxy-fuel burners. Importantly, the body of the burner is protected from the furnace radiation by the refractory burner block, that possesses a cavity that opens into the furnace. The cavity has a generally cylindrical cross section, although any equivalent cross section can be used, such as square, rectangular, ellipsoid, oval, and the like.

The burner block and any associated assembly or housing, according to the process of the present invention, must be installed in the furnace refractory crown, so as to provide access to the furnace interior for the burner and the combustion mixtures discharged therefrom, while maintaining the structural integrity of the furnace crown to protect the exterior from heat, glass volatiles and combustion products, and the interior from contamination and heat loss.

Examples of the installation of burner blocks in glass furnaces according to the present invention are set forth below. These examples illustrate, without limiting the invention to the specific methods described, how to accommodate differences in the materials of the refractory burner block and the furnace refractory, and to retrofit existing, hot furnaces with new burner blocks, in comparison to situations where issues of incompatibility and current operations are not factors.

EXAMPLE 1

Silica Burner Blocks in a Silica Crown

There is no chemical incompatibility between a silica burner block and a silica crown 11 and this is therefore the simplest case with installation processes similar in Hot, Cold and New installations. Firstly, all insulation 12 in the proximity of the burner block 14 (e.g. within a distance of 6–12" from the burner block) is removed from the exterior of the crown 11 (FIG. 1). The crown 11 is then drilled using a diamond core drill, which generally must be water-cooled. Due to the curvature of the crown in most instances, it is beneficial to core drill or pre-cast a silica spacer 13 block to act as a transition piece. This transition piece acts to raise the top of the burner block away from the heat of the crown and provide a level surface to obtain a seal. The burner block 14 is then installed in the crown through the drilled hole. Once the furnace has reached operating temperature, a layer of castable silica 16 may be poured between the transition block and the remaining insulation to provide a seal.

EXAMPLE 2

AZS, Zirconia or Zircon Burner Blocks in a Hot Silica Crown

In certain glass melting environments with high soda vapor concentrations, for example soda lime silicate silica oxy-fuel burner blocks have a short furnace life because of chemical attack. It has been found in this environment, that a zircon or AZS block has a greater resistance to chemical attack.

Figure 2:
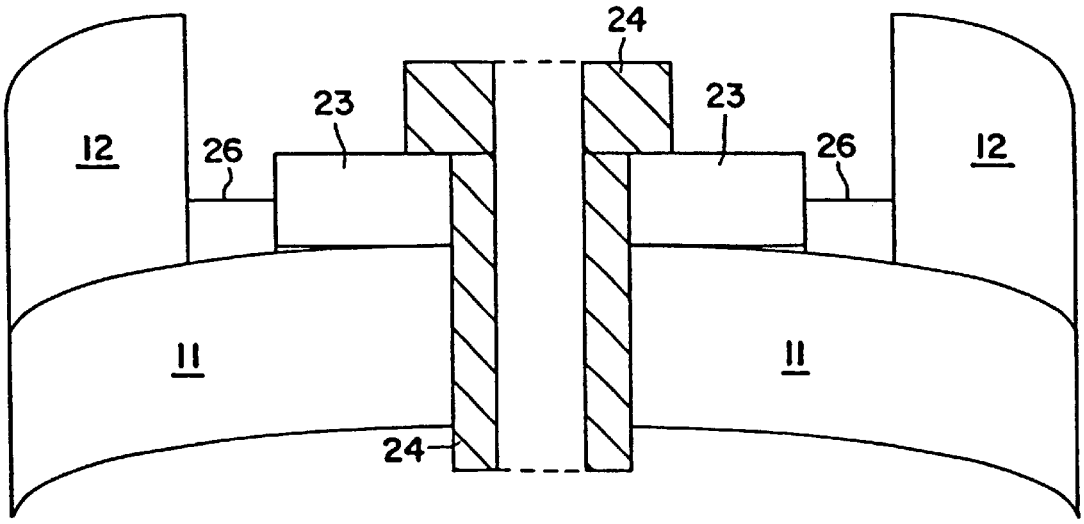
FIG. 2 is a schematic, elevational, cutaway view of a bonded AZS, zirconia or zircon burner block in a hot silica crown.

In order to retrofit an operating silica refractory glass furnace with a zirconia, zircon, or AZS burner block, any insulation is first removed from the exterior of the crown 11 (FIG. 2). The crown 11 is prepared by either ramming or casting an insulation patch 23 of chemically compatible refractory material, such as zircon, fused silica and the like, in the area of the crown where the burner block is to be inserted. One option is to place a removable metal form in position to form the hole, or by drilling. Another option is to cast a refractory cement around a permanent precast short refractory tube with an internal diameter fractionally larger than the outer diameter of the core drill.

Alternatively, this castable or rammed patch is left complete to be drilled with the crown. The crown is then drilled using a diamond core drill, which generally must be water-cooled. In the case of zircon and zirconia burner blocks 24, these are pre-heated to the maximum practical temperature before installation in order to prevent thermal shock. In the case of using a bonded AZS burner block 24, because of chemical incompatibility between the AZS and the silica crown, it is necessary to apply a chemical barrier, that is, a chemically compatible material, such as a zircon cement and the like, to the external surfaces of the burner blocks. The barrier-applied burner block is advantageously left overnight on top of the crown in order to set and to preheat.

Figure 6:
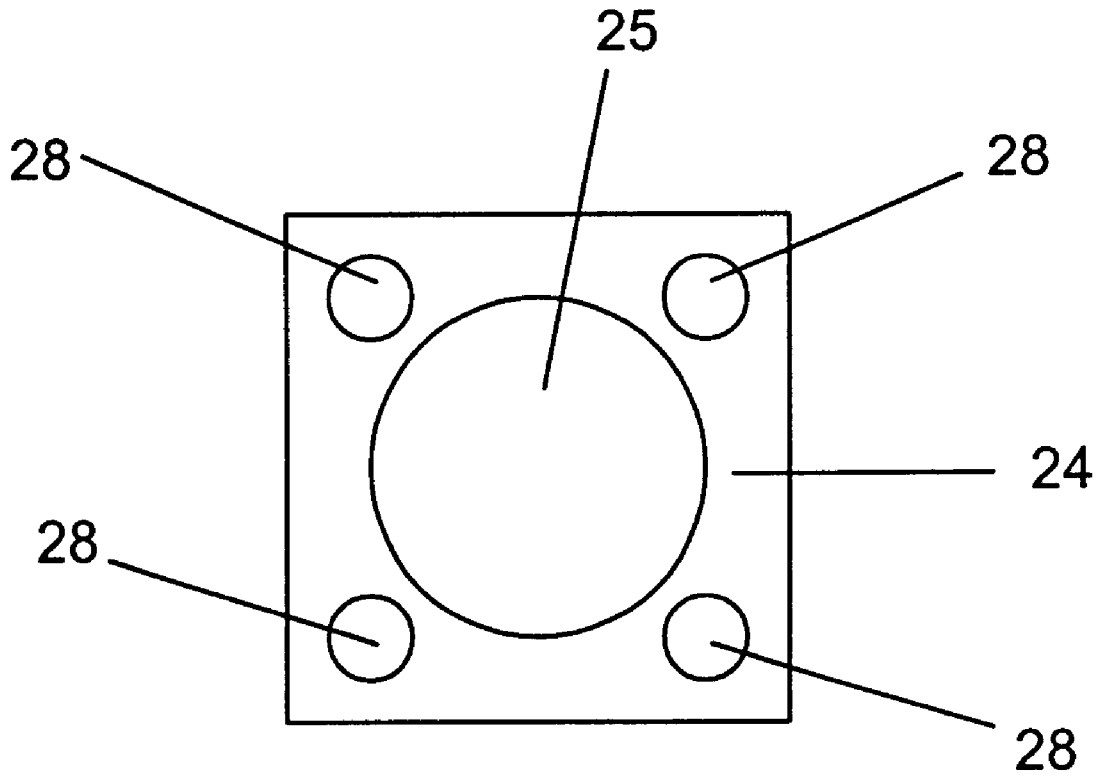
FIG. 6 is a bottom plan view of a burner block with holes for accepting oxidant discharge means.

All three types of burner block 24 are preferably installed with holes 25, 28 in the top of the burner block plugged, to minimise stack venting and to stop the flow of hot furnace gases through the block. As shown in FIG. 6, such holes include an aperture 25 for accepting the burner, as well as apertures 28 for accepting fuel discharging means and oxidant discharging means. This procedure minimises the risk of thermally shocking and breaking the burner block. In most instances, it is preferred to install the preheated burner blocks immediately following the drilling of the crown, since the freshly cut crown has been cooled by the water of the core drill. Once installed, an optional final pouring of a refractory cement 26, such as a castable silica or the like will ensure a seal between the insulation patch and the crown and/or crown insulation.

EXAMPLE 3

Bonded AZS, Zirconia or Zircon Burner Blocks in a New or Cold Silica Crown

Figure 3:
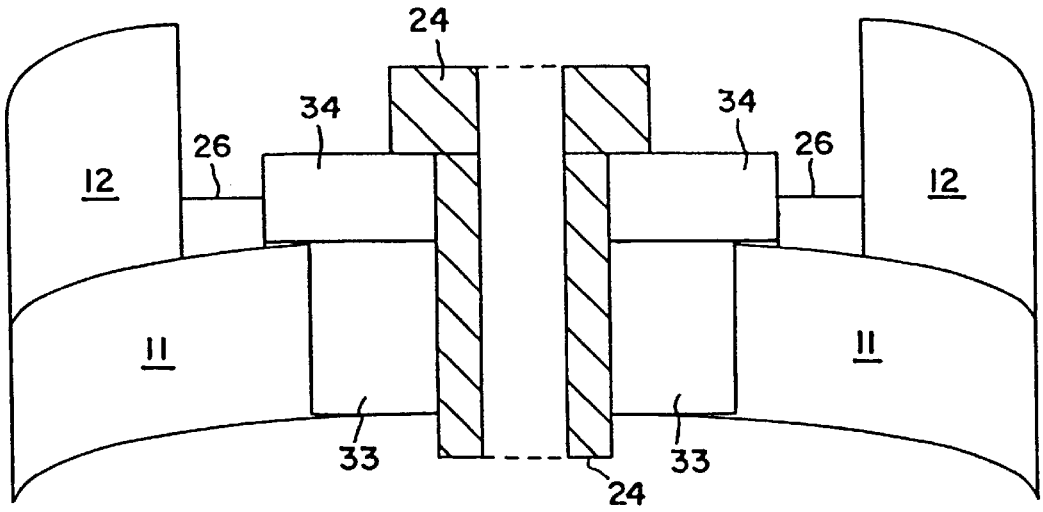
FIG. 3 is a schematic, elevational, cutaway view of a bonded AZS, zirconia or zircon burner block in a new or cold silica crown.
Figure 3A:
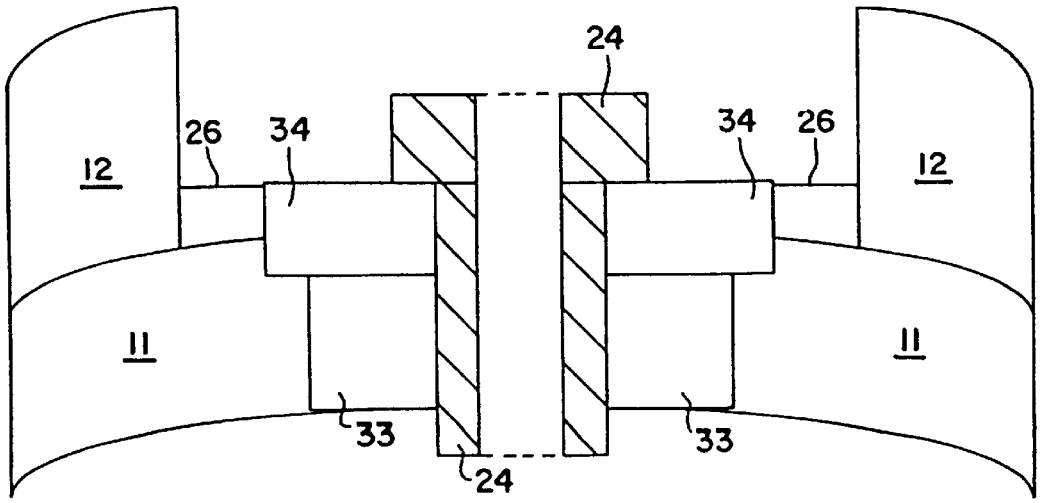
FIG. 3A is a schematic, elevational, cutaway view of an alternative embodiment of a bonded AZS, zirconia or zircon burner block in a new or cold silica crown.

In the case of a new furnace or a cold repair of an existing silica crown 11 there is the opportunity to install a dedicated crown block 33 having a hole to accept the burner block, already pre-drilled or cast. (FIG. 3) The crown block is ideally a chemically compatible material such as zircon and the like, to provide chemical compatibility with the silica. The crown block may have a greater overall depth than the silica crown, in part, taking into account the design of the lugs 34 integral to the crown block, to ensure that the crown block keys adequately in the crown and to provide support for the crown block so that it does not move downwards through the lighter furnace crown silica material. For example, the lugs may rest on top of the furnace crown as shown in FIG. 3, or may nest in a cut out top portion of the furnace crown refractory, as shown in FIG. 3A.

Figure 3B:
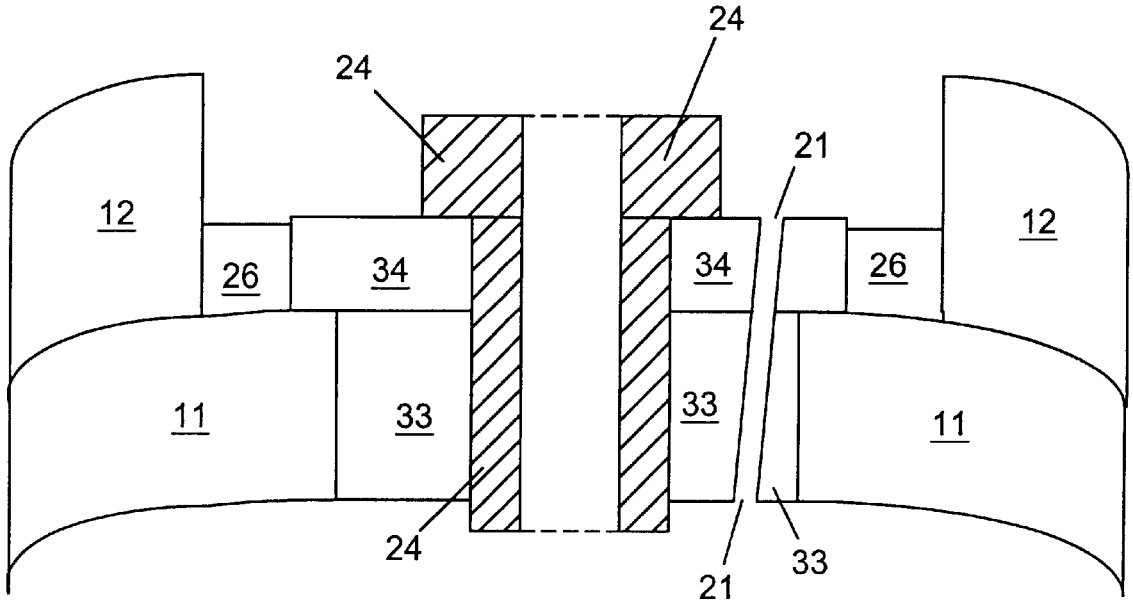
FIG. 3B is a schematic, elevational, cutaway view of an alternative embodiment of a bonded AZS, zirconia or zircon burner block in a new or cold silica crown including a second hole for accepting an externally staged oxygen injector.
Figure 3C:
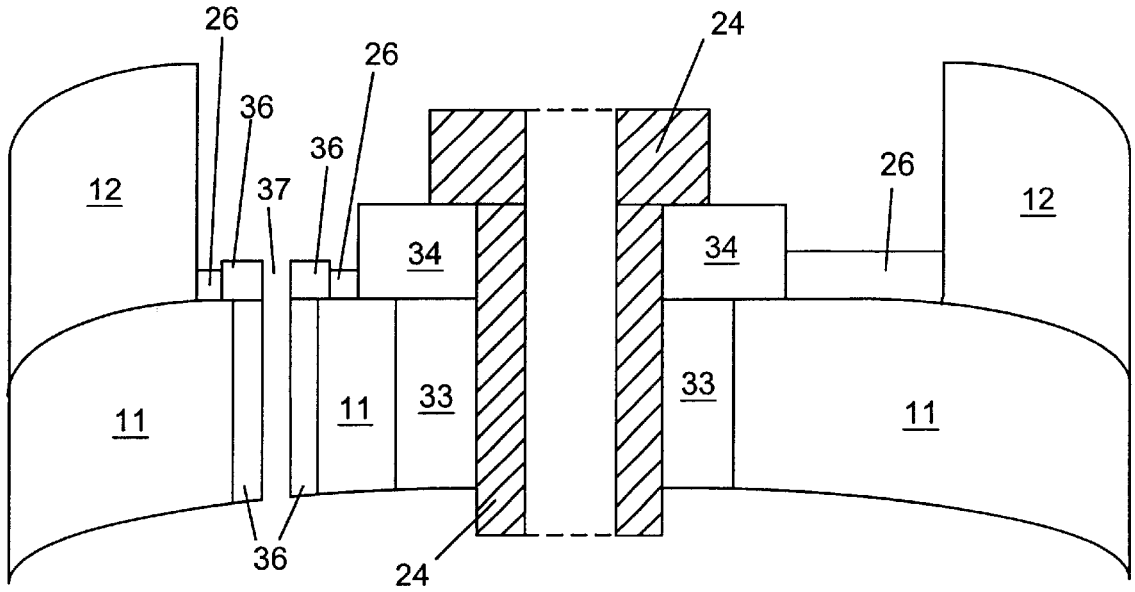
FIG. 3C is a schematic, elevational, cutaway view of an alternative embodiment of a bonded AZS, zirconia or zircon burner block in a new or cold silica crown including first and second crown blocks.
Figure 3D:
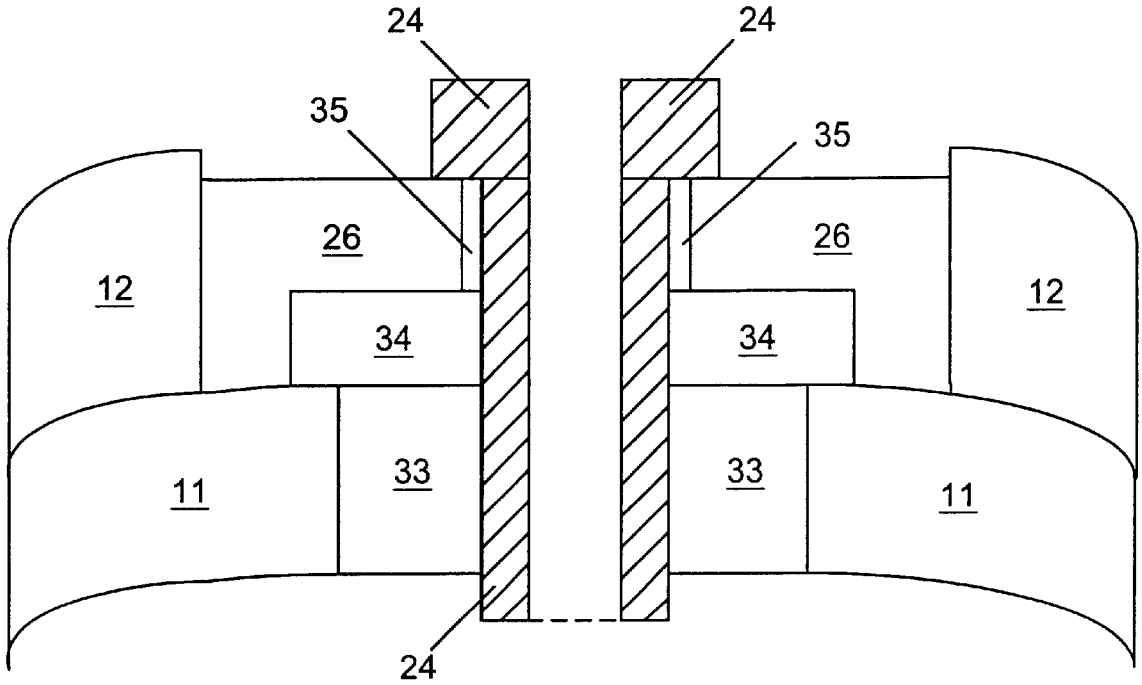
FIG. 3D is a schematic, elevational, cutaway view of an alternative embodiment of a bonded AZS, ziconia or zircon burner block in a new or cold silica crown including an insulating transition tube.

The crown block preferably should be drilled or cast so as to provide a flat perpendicular upper surface radially outwardly from the hole, on which the burner block can rest evenly, and to provide a seal. In certain circumstances, it may be beneficial to raise the burner block by using a transition tube 35 which is then secured and sealed in place above the crown block with a compatible castable material such as silica or the like as shown in FIG. 3D. As discussed above, once installed, an optional final pouring of castable material 26 such as silica or the like will ensure a seal between the crown block and the crown and/or crown insulation. The burner block 24 preferably should be installed prior to furnace heat-up in order to minimize thermal damage. In one embodiment, the crown block is provided with at least one hole 21 for accepting externally staged oxygen injector means as shown in FIG. 3B.

EXAMPLE 4

Figure 4:
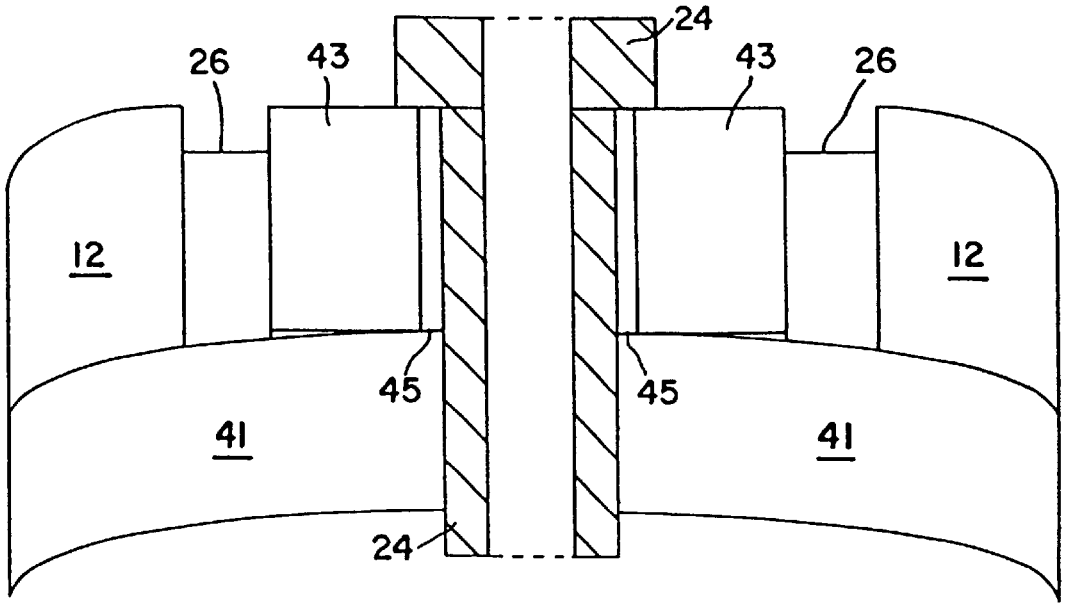
FIG. 4 is a schematic, elevational, cutaway view of a bonded AZS, zirconia or zircon burner block in a new, fused cast refractory crown.

Bonded AZS, Zirconia or Zircon Burner Blocks in a New Fused Cast Refractory Crown In certain glass melting environments, for example 100% oxygen-fuel furnaces, because of high operating temperatures and furnace atmosphere conditions, crowns have been manufactured using a fused cast refractory material, such as a fused cast alumina or a fused cast AZS. Referring to FIG. 4, because of the mechanical properties of this type of crown 41 it is not possible to drill when hot. The holes must either be cast during manufacture of the refractories for the structure, or drilled prior to furnace heat-up. Due to the high thermal conductivity of the fused cast refractory material, it is desirable to utilize a dedicated insulating barrier mounting block 43 to hold the burner block 24.

A chemically compatible material, such as a bonded AZS tube 45 is formed such that it can be disposed concentricly with the hole in the crown 41. Around this tube 45, a mold or former (not shown) is built, and an insulating castable material is poured, to produce an insulating block 43. Optionally, a multiple casting technique can be utilized, such that a high temperature insulating castable material such as a high alumina castable material, ie, 98% alumina or the like, is poured, followed by a second (or more) casting of lower temperature castable material(s) such as calcium aluminate cement (for example, 44% $Al_2O_3$, 35% $SiO_2$, 17% CaO) or the like, with higher insulative properties, to produce the composite insulating block 43. Once the castables are set, the molds or formers are removed. The burner block 24 is preferably installed cold, and allowed to heat-up with the furnace. Once the furnace has heated up to operating temperature, it is optional to pour a castable material 26 such as silica or the like, to seal the area between the insulating mounting block 43 and the crown insulation 12.

It should be understood that while it is advisable to drill the hole in the fused cast refractory material when it is cold, it is within the scope of this invention to prepare the insulating mounting block 43 when the furnace crown is not hot, and then remove it, substituting a replacement refractory brick and insulation in its place. At a later time, even when the furnace is hot, the replacement brick and insulation can be removed, and the burner block/insulating mounting block inserted into the hole.

This installation method can also be used for other furnace crown refractory types, including but not limited to silica. When the furnace crown comprises a silica refractory material, the installation process includes coating the burner block with a refractory material, such as a zircon cement or the like, that is compatible with both the silica refractory and the burner block, in order to render the burner block compatible with the silica refractory.

EXAMPLE 5

Burner Block with External Staging Means

Staged combustion has been proposed for glass furnace burners, such as those in which a fuel rich oxy-fuel mixture is injected into the furnace from a burner, and additional oxygen is injected by means external to the burner block in order to provide complete combustion displaced from the burner exit. In the instance of roof-mounted burners, preferably complete combustion would occur in the proximity of the surface of the raw batch materials. Preferably, additional oxygen injectors would be positioned to delay complete combustion until after the flame has impinged on the surface of the raw batch. The location of the additional injectors is dependant upon the desired operating conditions of the burner(s), as well as burner location and number.

According to the present invention, externally staged combustion is provided by installing at least one oxygen injector means in the roof or crown of the furnace. Depending upon the materials of the furnace crown refractories and the injector tubes selected for housing the injection means, the above-described methods for installing the burner block may be adapted for the installation of the oxygen tubes.

Figure 5:
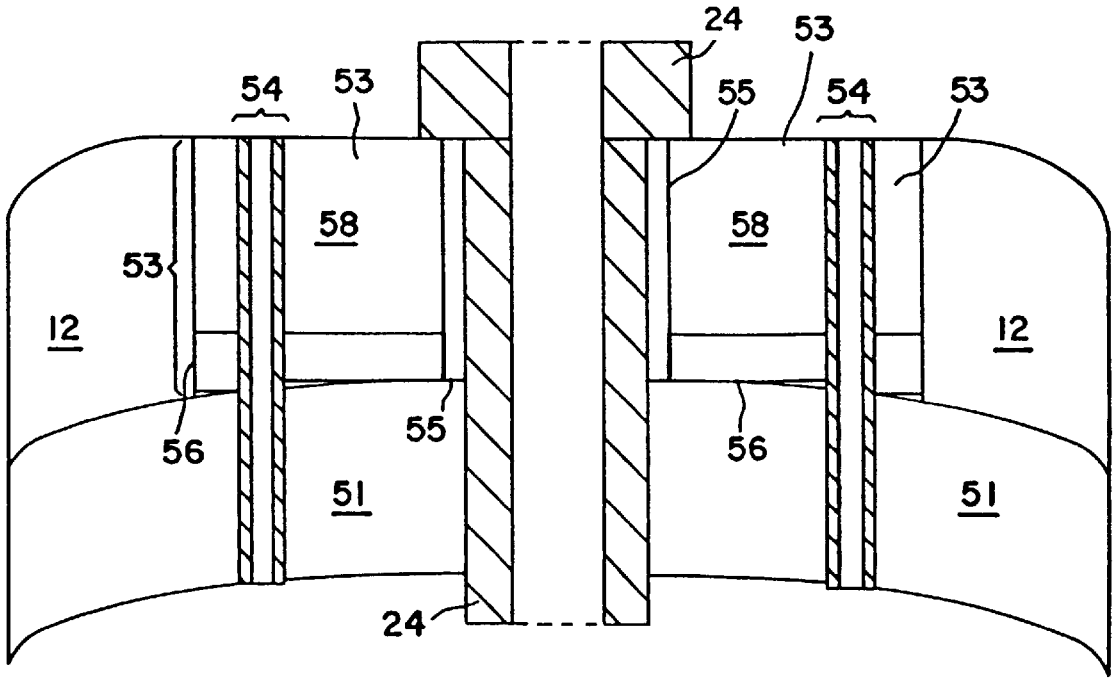
FIG. 5 is a schematic, elevational, cutaway view of a bonded AZS, zirconia or zircon burner block with external oxidant staging crown entry points.

In one embodiment, both the burner block 24 and one or more oxygen injector tubes 54 are installed in a single insulating mounting block 53 (FIG. 5). Holes are drilled into the furnace crown 51 as discussed above, and a tube 55 of compatible material, such as bonded AZS, is positioned in one hole to accommodate the burner block. High temperature resistant compatible material oxygen injector tubes 54 such as mullite, alumina, or the like, are coated with a compatible heat set mortar and are positioned with respect to the other hole or holes. A compatible high temperature resistant material patch 56 such as a zircon patch is applied, preferably followed by a high temperature castable material 58 which is allowed to set. The patch 56 and the castable material 58 together may comprise the insulating mounting block 53.

Figure 2A:
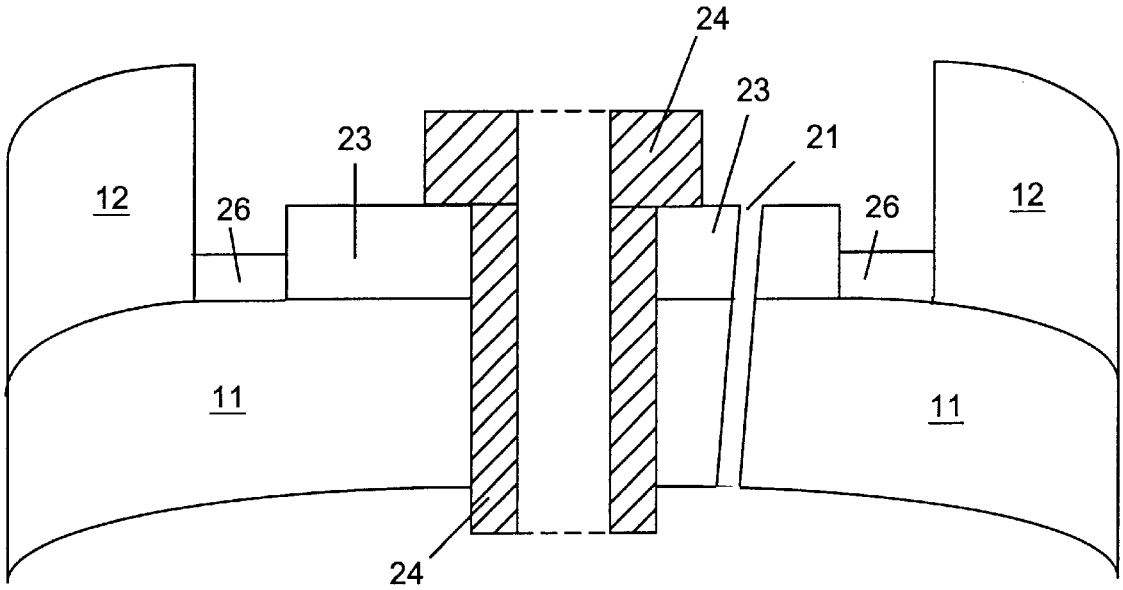
FIG. 2A is a schematic, elevational, cutaway view of an alternative embodiment of a bonded AZS, zirconia or zircon burner block in a hot silica crown including a second hole for inserting an externally staged oxygen injector.
Figure 2B:
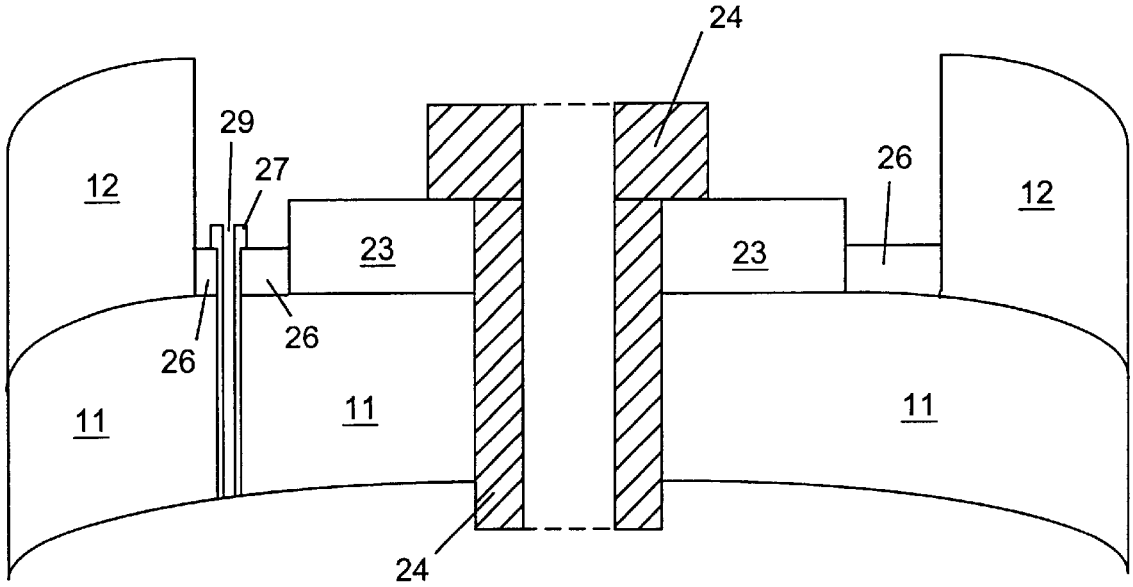
FIG. 2B is a schematic, elevational, cutaway view of an alternative embodiment of a bonded AZS, zirconia or zircon burner block in hot silica crown including a second patch of refractory material with at least one hole for inserting an externally staged oxygen injector.

It should be understood that the oxygen injector tubes can be installed in the furnace crown in a hole 21 in an insulating mounting block, crown block, patch, or the like, prepared substantially as described above, separately from that insulating mounting block, crown block, patch, or the like which accommodates the burner block, in any suitable location, to give the staged combustion effects desired. In the embodiment shown in FIG. 2B, at least a second patch 27 of refractory material compatible with the furnace crown second refractory material is provided with at least one hole 29 for accepting externally staged oxygen injection means. FIG. 3C shows an embodiment having at least a second refractory crown block 36 of refractory material compatible with the furnace crown refractory material provided with at least one hole 37 for accepting externally staged oxygen injector means. The embodiment shown in FIG. 2A includes drilling at least a second hole 21 into the crown 11 through the refractory patch 23, for accepting at least one externally staged oxygen injector.

For example, an externally staged oxygen-fuel burner can be installed in a glass furnace crown, such as, but not limited to a silica refractory crown as in Example 1, by drilling into the furnace crown, at least a first hole for accepting a burner block and at least a second hole 21 (or more) for accepting at least one externally staged oxygen injector. At least a first transition block spacer is positioned over the first hole, that is provided, such as by drilling or casting, with a hole for accepting the burner block in communication with the first hole. Either the first transition block spacer or optionally at least a second transition block spacer (or more) is positioned over the second and any further holes in the crown, which spacers are also provided with at least one oxygen injector hole for accepting the oxygen injector means in communication with the second crown refractory hole(s). The burner block is inserted through the first transition block spacer into the first hole in sealing engagement and the externally staged oxygen injector means are inserted through either the first or the second transition block spacer(s) into the second hole(s) in sealing engagement. Preferably, a castable material such as silica is applied, such as being poured, to seal the transition block spacer(s) to the crown refractory and/or crown insulation.

Although the Figures show the burner block inserted perpendicularly to the plane of the furnace crown, the assembly can be angled, such that the long axis of the burner block is disposed between about 45° and about 90° with respect to the horizontal plane of the furnace crown, to provide desired burner placement. Similarly, any externally staged oxygen injector means can be installed substantially perpendicular to, or angled from the horizontal plane of the furnace crown.

It is within the scope of this invention to install one or more roof mounted oxygen fuel burners in a glass furnace, In one embodiment, a single roof mounted oxygen-fuel burner may be installed in a glass furnace crown, disposed so as to be positioned in operation over unmelted batch materials entering the furnace. However, any number of roof mounted oxygen-fuel burners may be installed in any suitable location in the furnace crown to melt or fine the glass batch materials. For purposes of illustration but not for purposes of limitation, a roof mounted oxygen-fuel burner may be installed upstream of one or more adjacently positioned downstream roof mounted oxygen-fuel burners. In another embodiment, two roof mounted oxygen-fuel burners may be installed side by side in relation to the flow of material in the furnace.

It should be appreciated that the present invention is not limited to the specific embodiments described above, but includes variations, modifications and equivalent embodiments defined by the following claims.

What is claimed is:

1. A process for installing a refractory burner block in a glass furnace crown, wherein the glass furnace crown comprises a second refractory material different than the burner block refractory, comprising:

installing a refractory crown block in the furnace crown, wherein the crown block refractory is compatible with the burner block refractory and the second refractory material, wherein the crown block is provided with a hole for accepting the burner block; and, disposing the burner block into the crown block hole in sealing engagement therewith.

2. The process of claim 1, including providing the crown block with a substantially flat, perpendicular upper surface radially outwardly from the hole.

3. The process of claim 2 wherein the crown block is provided with said hole and said flat upper surface by one of casting and drilling.

4. The process of claim 1, wherein the crown block has a top portion above the furnace crown, and includes integral lugs disposed in the top portion of the crown block, including positioning the lugs with respect to the furnace crown to provide added support for the burner block and to assist in the sealing engagement of the burner block with the crown block.

5. The process of claim 1 including disposing an insulating transition tube between the crown block and the burner block.

6. The process of claim 1 wherein crown insulation is disposed above the furnace crown and adjacent to the crown block, including securing and sealing the crown block to the furnace crown and crown insulation with a refractory castable material.

7. The process of claim 1 wherein the furnace crown refractory material is silica.

8. The process of claim 1 wherein the burner block refractory material is selected from the group consisting of alumina zirconia silica (AZS), zircon, and zirconia.

9. The process of claim 1 wherein the burner block is adapted to include at least one aperture for accepting staged oxidant discharge means.

10. The process of claim 1, wherein the crown block has a greater overall depth than the furnace crown refractory.

11. The process of claim 1, wherein the burner block has a long axis and the furnace crown has a horizontal plane, including disposing the burner block such that the burner block long axis is between about 45° and about 90° with respect to the horizontal plane of the furnace crown.

12. The process of claim 1, wherein the crown block is provided with at least one hole for accepting externally staged oxygen injector means.

13. The process of claim 1, wherein at least a second refractory crown block is provided with at least one hole for accepting externally staged oxygen injector means; including installing the at least second refractory crown block in the furnace crown, wherein the at least second crown block refractory is compatible with the second refractory material; and disposing the oxygen injector means into the crown block hole of the at least second refractory crown block in sealing engagement therewith.

14. A process for installing a refractory burner block in a hot glass furnace crown, wherein the glass furnace crown comprises a second refractory material different than the burner block refractory, comprising:

removing crown insulation from the exterior of the furnace crown;

inserting a patch of refractory material compatible with the furnace crown second refractory material into the crown in the vicinity of the removed insulation;

drilling a hole into the crown through the refractory patch, optionally with a water cooled diamond drill; and, inserting the refractory burner block into the hole in the furnace crown through the refractory patch.

15. The process of claim 14, wherein said inserting a patch includes placing a removable form in position to form the hole in the furnace crown.

16. The process of claim 14, wherein said inserting a patch includes casting a refractory cement around a precast refractory tube having an internal diameter larger than the drill core.

17. The process of claim 14, including preheating the refractory burner block prior to insertion in the furnace crown.

18. The process of claim 14 wherein the burner block refractory is incompatible with the furnace crown second refractory material, including applying a chemical barrier to be disposed between the external surfaces of the burner block refractory and the furnace crown second refractory material, which chemical barrier is chemically compatible with the burner block refractory and the furnace crown second refractory material, prior to insertion of the burner block in the furnace crown.

19. The process of claim 18 wherein the burner block refractory is AZS and the chemical barrier is zircon.

20. The process of claim 14 wherein the burner block contains at least one hole adapted for accepting at least one of a burner, fuel discharging means and oxidant discharging means, including plugging the top of the burner block at least one hole prior to insertion in the furnace crown.

21. The process of claim 14 including securing and sealing the patch to at least one of the furnace crown and furnace insulation with a refractory cement, optionally a silica castable cement.

22. The process of claim 14 wherein the furnace crown refractory material is silica.

23. The process of claim 14 wherein the burner block refractory material is selected from the group consisting of alumina zirconia silica (AZS), zircon, and zirconia.

24. The process of claim 14 wherein the burner block is adapted to include at least one aperture for accepting staged oxidant discharge means.

25. The process of claim 14, wherein the burner block has a long axis and the furnace crown has a horizontal plane, including inserting the refractory burner block such that the burner block long axis is between about 45° and about 90° with respect to the horizontal plane of the furnace crown.

26. The process of claim 14, including drilling at least a second hole into the crown through the refractory patch, adapted for inserting at least one externally staged oxygen injector means into the at least second hole in the furnace crown through the refractory patch.

27. The process of claim 14, including inserting at least a second patch of refractory material compatible with the furnace crown second refractory material into the crown in the vicinity of the removed insulation;

drilling at least one hole into the crown through the at least second refractory patch, optionally with a water cooled diamond drill; and, inserting at least one externally staged oxygen injector means into the at least one hole in the furnace crown through the at least second refractory patch.

28. A process for installing a refractory burner block in a glass furnace crown, wherein the glass furnace crown comprises a refractory material, comprising:

installing an insulating barrier mounting block on the upper surface of the furnace crown, wherein the mounting block is compatible with the burner block refractory and the refractory material, wherein the mounting block is provided with a hole for accepting the burner block, and wherein the insulating barrier mounting block is prepared when the furnace crown is not hot; and, disposing the burner block into the mounting block hole in sealing engagement therewith.

29. The process of claim 28 wherein the mounting block is provided by:

disposing a refractory tube, optionally a bonded AZS refractory tube, concentrically within a hole in a furnace crown refractory;

disposing a mold around the tube and pouring into the mold a high temperature insulating castable material;

optionally repeating said molding and pouring with at least a second, lower temperature castable material having higher insulating properties than the high temperature insulating castable material; and, setting the castable material to produce a composite insulating mounting block.

30. The process of claim 29 wherein the high temperature insulating castable material is an alumina castable material, and the second, lower temperature castable material is a calcium aluminate cement.

31. The process of claim 28, including heating the furnace to operating temperature, and pouring a refractory castable cement to seal the mounting block and furnace crown insulation.

32. The process of claim 28 wherein the burner block refractory material is selected from the group consisting of silica, alumina zirconia silica (AZS), zircon, and zirconia.

33. The process of claim 28 wherein the burner block is adapted to include at least one aperture for accepting staged oxidant discharge means.

34. The process of claim 28 wherein the burner block contains at least one hole adapted for accepting at least one of a burner, fuel discharging means and oxidant discharging means, including plugging the top of the burner block at least one hole prior to insertion in the furnace crown.

35. The process of claim 28 including disposing the burner block such that the burner block long axis is between about 45° and 90° with respect to the horizontal plane of the furnace crown.

36. The process of claim 28 wherein the mounting block is provided with at least a second hole for accepting at least one externally staged oxygen injector means, including disposing the at least one externally staged oxygen injector means into the at least second hole.

37. The process of claim 28, including installing at least a second insulating barrier mounting block on the upper surface of the furnace crown, wherein the mounting block is compatible with the burner block refractory and the refractory material, wherein the mounting block is provided with a hole for accepting at least one externally staged oxygen injector means, and wherein the at least second insulating barrier mounting block is prepared when the furnace crown is not hot; and, disposing the at least one externally staged oxygen injector means into the mounting block hole in sealing engagement therewith.

38. The process of claim 28, wherein the furnace crown comprises a thermally conductive fused cast refractory material.

39. The process of claim 28, wherein the furnace crown comprises a silica refractory material, including coating the burner block with a refractory material, optionally zircon, compatible with the silica refractory and the burner block to render the burner block compatible with the silica refractory.

40. A process for installing an externally staged oxygen-fuel burner in a glass furnace crown, comprising:

drilling in the furnace crown, at least a first hole for accepting a burner block and at least a second hole for accepting at least one externally staged oxygen injector means;

positioning a first transition block spacer over the first hole, said first transition block spacer being provided with a burner block hole for accepting the burner block in communication with the first hole;

positioning one of the first transition block spacer and an optional at least second transition block spacer over the at least second hole, said first or at least second transition block spacer being provided with at least one oxygen injector hole for accepting the oxygen injector means in communication with the at least second hole, inserting the burner block through the first transition block spacer into the first hole in sealing engagement;

inserting an externally staged oxygen injector means through at least one of said first and second transition block spacer into the at least second hole in sealing engagement; and applying a castable material to seal the first and optional second transition block spacer.

41. A furnace structure for accepting a burner comprising a furnace refractory structure;

an insulation patch of refractory material compatible with the furnace refractory positioned external to the furnace refractory structure, said furnace refractory structure and said insulation patch each having at least one hole aligned therethrough to the interior of the furnace structure;

a refractory burner block having a portion disposed outside the insulation patch, a second portion disposed within said at least one aligned holes, and an aperture for accepting a burner, said burner block optionally including at least a second aperture for accepting at least one of fuel discharging means and oxygen discharging means; and, optionally a refractory sealing means for ensuring a seal between the insulation patch and the furnace refractory structure.

42. The furnace structure of claim 41, further including a refractory tube disposed between the insulation patch and the burner block.

43. The furnace structure of claim 41, wherein the refractory burner block is chemically incompatible with the furnace refractory, further including a compatible chemical barrier disposed between the burner block and the furnace refractory.

44. A furnace structure for accepting a burner comprising:

a furnace refractory structure;

a dedicated block chemically compatible with the furnace structure refractory having a hole to accept a burner block, said dedicated block being disposed integral to the furnace structure and optionally having an overall depth greater than the furnace structure refractory, said dedicated block having integral lugs external to the furnace structure and optionally nested in an external portion of the furnace structure, said dedicated block optionally having a substantially flat surface radially outwardly from the hole;

a refractory burner block having a portion disposed outside the dedicated block proximate to the dedicated block radially outward surface, a second portion disposed within said hole, and an aperture for accepting a burner, said burner block optionally including at least a second aperture for accepting at least one of fuel discharging means and oxygen discharging means;

optionally a transition tube disposed between the dedicated block radially outward surface and the burner block; and, optionally a refractory sealing means for ensuring a seal between the dedicated block and the furnace refractory structure.

45. A furnace structure for accepting a burner comprising:

a furnace refractory structure having an interior;

a dedicated insulating barrier mounting block comprising a tube chemically compatible with the furnace structure refractory, a high temperature castable material disposed concentrically outward of the tube, and optionally a castable material having insulating properties higher than the high temperature castable material disposed concentrically outward of the tube and distal to the furnace refractory structure, said dedicated insulating barrier mounting block being positioned external to the furnace refractory structure, said furnace refractory structure and said dedicated insulating barrier mounting block each having at least one hole aligned therethrough to the interior of the furnace structure, said tube being disposed generally concentrically outward of said at least one aligned holes;

a refractory burner block having a portion disposed outside the dedicated insulating barrier mounting block, a second portion disposed within said at least one aligned holes, and an aperture for accepting a burner, said burner block optionally including at least a second aperture for accepting at least one of fuel discharging means and oxygen discharging means; and, optionally a refractory sealing means for ensuring a seal between the dedicated insulating barrier mounting block and the furnace refractory structure.

46. The furnace structure of claim 45, wherein the refractory burner block is chemically incompatible with the furnace refractory, further including a compatible refractory material disposed between the burner block and the furnace refractory.

47. The furnace structure of claim 45, wherein said furnace refractory structure and said dedicated insulating barrier mounting block each have at least a second hole aligned therethrough to the interior of the furnace structure for accepting oxygen injector means.

48. A process for installing a refractory burner block in a glass furnace crown, wherein the glass furnace crown comprises a furnace crown refractory material, and wherein the furnace crown refractory material comprises a refractory material different than the burner block refractory, the process comprising:

disposing a refractory patch or refractory block on or in the furnace crown, wherein the refractory patch or refractory block is compatible or rendered compatible with the burner block refractory and the furnace crown refractory material, providing the furnace crown and the refractory patch or refractory block with a hole for accepting the burner block; and, disposing the burner block into the refractory patch or refractory block hole in sealing engagement therewith.

49. A furnace structure for accepting a burner comprising a furnace refractory structure;

a refractory patch or refractory block compatible or rendered compatible with the furnace refractory disposed external to or integral to the furnace refractory structure, said furnace refractory structure and said refractory patch or refractory block each having at least one hole aligned therethrough to the interior of the furnace structure;

a refractory burner block comprising a refractory material different than the furnace refractory structure material, said refractory burner block having a portion disposed outside the refractory patch or refractory block, a second portion disposed within said at least one aligned hole, and an aperture for accepting a burner, said refractory burner block optionally including at least a second aperture for accepting at least one of fuel discharging means and oxygen discharging means; and, optionally a refractory sealing means for ensuring a seal between the refractory patch or refractory block and the furnace refractory structure.

* * * * *